United States Patent [19]

Honma

[11] 4,260,984

[45] Apr. 7, 1981

[54] COUNT DISCRIMINATING FIRE DETECTOR

[75] Inventor: Hiroshi Honma, Hino, Japan

[73] Assignee: Hochiki Corporation, Tokyo, Japan

[21] Appl. No.: 129,836

[22] Filed: Mar. 13, 1980

[30] Foreign Application Priority Data

Mar. 17, 1979 [JP] Japan ..... 54-33726[U]
Mar. 17, 1979 [JP] Japan ..... 54-33727[U]

[51] Int. Cl.[3] ..... G08B 17/10

[52] U.S. Cl. ..... 340/630; 250/381; 250/574; 340/629

[58] Field of Search ..... 340/628, 629, 630; 250/564, 565, 573, 574, 575, 381; 356/438, 439

[56] References Cited

U.S. PATENT DOCUMENTS

| | | | |
|---|---|---|---|
| 3,842,409 | 10/1974 | Mayer | 340/629 X |
| 3,846,772 | 11/1974 | Peberdy | 250/564 X |
| 3,946,241 | 3/1976 | Malinowski | 250/574 |
| 4,011,458 | 3/1977 | Malinowski | 250/564 |
| 4,015,121 | 3/1977 | Gagnon et al. | 250/575 X |
| 4,151,522 | 4/1979 | Yamauchi | 340/628 X |
| 4,163,969 | 8/1979 | Enemark | 340/630 |
| 4,185,278 | 1/1980 | Linlelmann et al. | 340/630 |
| 4,186,390 | 1/1980 | Enemark | 340/630 |
| 4,193,069 | 3/1980 | Cooper et al. | 340/630 |

*Primary Examiner*—John W. Caldwell, Sr.
*Assistant Examiner*—Daniel Myer
*Attorney, Agent, or Firm*—Haseltine and Lake

[57] ABSTRACT

A detecting circuit is responsive to the change in a physical parameter indicative of a fire such as smoke, heat, flame or the like, and a comparator circuit connected to the detecting circuit produces detection pulses in synchronism with an oscillator circuit when the change in the physical parameter exceeds a predetermined amount. A counter circuit counts the detection pulses and produces an output which triggers a switching circuit when a predetermined number of consecutive detection pulses are counted. When triggered, the switching circuit transmits an alarm signal to an alarm receiving panel. Connected between the counter circuit and the switching circuit is a monostable multivibrator having a time constant which is equal to or smaller than the supply voltage rise time constant of the counter circuit so as to prevent the trigger signal from being applied to the switching circuit during the transition period immediately following the connection of the power source. A detection sensitivity validation means directs the detection pulses from the comparator circuit to the outside so as to facilitate the sensitivity adjustment.

6 Claims, 6 Drawing Figures

COUNT DISCRIMINATING FIRE DETECTOR

BACKGROUND OF THE INVENTION

The present invention relates to count discriminating fire detectors of the type which produces an alarm signal in response to the counting of a predetermined number of pulses generated from the output of a fire sensor, and more particularly the invention relates to such detector which includes a monostable multivibrator so that the production of a false alarm signal due to any undesirable operation of the counter circuit upon connection or reconnection of the power source is prevented.

In the past, a so-called pulse-drive method designed to periodically monitor for fire with a view to reducing the detector current consumption has been used with known photo-electric smoke detectors, ionization smoke detectors and semiconductor heat detectors other than mechanical-contact type fire detectors employing a heat-sensitive member such as a bimetal or diaphragm. In addition, a so-called storage type fire detector has been put in practical use in which to prevent the production of a false alarm signal due to a non-fire cause such as an external noise or tobacco smoke which lasts only a short period of time, an alarm signal is produced only upon continuation of a fire condition over 20 seconds, for example. Since this type of storage type fire detector uses a pulse-drive method as mentioned previously, the function of the detector as the storage type will be made inoperative if the pulse spacing is greater than the storage interval. As a result, where the storage interval is for example greater than 20 seconds, the monitoring for fire is accomplished with an 8-second period pulse spacing so that an alarm signal is produced only when the presence of a fire is determined consecutively over four times, and a digital counter circuit or analog counter circuit is used for counting the number of times the presence of fire is determined.

In the like manner as the ordinary fire detector, a desired number of such storage type fire detectors are connected in parallel between a pair of power supply and signal lines from an alarm receiving panel so that the detectors are supplied with a DC power from the receiving panel through the lines and upon occurrence of a fire the detector sends to the receiving panel through the same lines an alarm signal such as a switching signal which for example establishes a low impedance between the lines. The current consumption of such pulse-operated fire detectors is such that although the pulse width is as short as 100 to 200 μsec, the current consumption per unit may sometime amount momentarily to as much as several hundreds mA. Particularly, since the current consumption of a photoelectric type detector is so large and since a plurality of such pulse-operated fire detectors are connected to the same lines, a large current is drawn from the receiving panel and thus there is the danger of a signal detecting relay in the receiving panel being cause to respond to the large current erroneously and produce a false alarm. As a result, generally this type of fire detector incorporates a large-capacity capacitor as an internal power supply so that the DC power input from the lines is stored in the capacitor and then the required pulse-drive current is derived from the capacitor. Thus a switching circuit for producing an alarm signal is directly supplied from the lines so as to be not influenced by the capacitor. When the power source is connected, due to the presence of the capacitor, the gradually rising power supply voltage is applied to pulse-operated circuit and a counter circuit and the voltage rise time constant is relatively large. To forcibly reset the counter circuit upon connection of the power source is important for the prevention of any false alarm signal upon closing the power supply circuit, and a storage type detector having such reset means is disclosed for example in U.S. Pat. No. 3,842,409 and 4,151,522, in which the reset means comprises a differentiation circuit consisting of a capacitor and a resistor. The problem with this method of forcibly resetting the counter circuit through the differentiation circuit is that although the method is surely effective in preventing any malfunction during the charging period of the large-capacity capacitor upon closing the power circuit, the method has no malfunction preventing effect when upon releasing the supply voltage is applied again to the detector which has produced an alarm signal. More specifically, when the detector produces an alarm signal, its switching circuit establishes a low impedance short-circuit between the lines so that the charging of the large-capacity capacitor is stopped and the capacitor starts discharging its stored charge. Since this discharge takes place through the C-MOS device in the counter circuit, the discharge is effected very slowly and usually the time required for completing the discharge is over 10 minutes. When the alarm signal reaches the receiving panel, for the purpose of confirmation the operated detector is restored to the normal state so as to confirm if the detector again produces an alarm signal, and this releasing operation is usually performed in a time interval shorter than 10 minutes. Consequently, chances are great that reapplication of the power supply voltage upon restoration of the detector takes place before the completion of the discharge of the large-capacity capacitor, with the result that the change in the supply voltage applied to the differentiation circuit is reduced and the counter circuit is no longer reset, thus making it impossible to prevent erroneous triggering of the switching circuit.

This releasing operation will be performed not only in the actually installed fire alarm system but also in the course of adjusting tests of storage type fire detectors prior to their shipping from the factory. Thus the problem of inability to reset the counter circuit has a detrimental effect on the adjusting test works. Usually, for this type of detector the adjustment of sensitivity and storage interval is carried out by repeatedly operating the individual units separately under a simulated fire condition for testing purposes. For instance, in the case of a smoke detector, after the detector has been warmed up sufficiently, the detector is placed in a mass of smoke having a predetermined density to test the detector as to whether an alarm signal is produced in response to the smoke of this density and the time elapsed between the time of placing the detector in the smoke and the time of producing an alarm signal while releasing the detector as occasions demand, and the test process is performed repeatedly. The time required for the detector to produce an alarm after placing it in the smoke is more than the storage interval of over 20 seconds as mentioned previously and whether an alarm signal is produced within the upper limit time of the test criterion such as 60 seconds is confirmed. As a result, the minimum time of 20 seconds is required to make one test on each detector and an additional time of 20 seconds will be required for each releasing of the detector. It will thus be seen that the product testing of the storage type detectors requires a long period of time, that if the sensitivity adjustment is carried out along with the testing, the efficiency of these works will be extremely deteriorated due to the problem of inability to reset the counter circuit and that the efficiency will be deteriorated further if any malfunction takes place upon releasing.

SUMMARY OF THE INVENTION

It is an object of the invention to provide a storage type fire detector capable of preventing the production of a false alarm signal upon closing the power circuit and also preventing the production of a false alarm signal by the reapplication of the supply voltage upon releasing of the detector.

It is another object of the invention to provide a count discriminating fire detector in which a monostable multivibrator is provided for a switching circuit adapted to emit an alarm signal to thereby prevent any erroneous application of a trigger signal to the switching circuit from a counter circuit upon closing the power circuit or reapplication of the supply voltage.

It is still another object of the invention to provide such fire detector including a counter circuit adapted to reset itself positively when its own output remains on over a predetermined time and a monostable multivibrator, whereby the detector is positively released after the production of an alarm signal and the production of a false alarm signal due to reapplication of the supply voltage upon releasing is also prevented, thus eliminating inconveniences due to the occurrence of false alarm signals from the standpoint of actual use as well as from the standpoint of the performance testing and the adjustment work for sensitivity, etc., prior to the shipment of detector from the factory.

The ordinary count discriminating fire detector comprises a detecting circuit responsive to the change in a physical parameter indicative of a fire, such as, smoke, heat, flame or the like and adapted to be energized by pulses such that in response to a change in the physical parameter a pulse output having an amplitude corresponding to the amount of the change is produced at a predetermined period, a comparator circuit whereby when the amplitude level of the pulse output exceeds a predetermined reference level, detection pulses are produced in synchronism with the said period, a counter circuit for producing an output pulse in response to the application of a predetermined number of consecutive detection pulses and adapted to be reset at the expiration of a predetermined time after the interruption of detection pulses, a switching circuit responsive to the output pulse of the counter circuit to produce an alarm signal, an oscillator circuit for producing pulses to drive the detecting circuit, and an internal power supply circuit including a current limiting circuit and a capacitor for supplying the supply power by its stored charge to the counter circuit, the oscillator circuit, the detecting circuit and the comparator circuit, wherein the switching circuit is connected between a pair of power supply and signal lines or circuits from an alarm receiving panel such that the switching circuit is directly supplied with a DC power through the lines and when operated the switching circuit establishes a low impedance between the lines to thereby send an alarm signal to the receiving panel, and the detecting circuits, the comparator circuit, the counter circuit and the oscillator circuit are supplied with the DC power from the lines through the internal power supply circuit.

In accordance with the fire detector of this invention, there are further provided a resetting integrator circuit for integrating the counter output to produce a reset signal and thereby to reset the counter circuit at the expiration of a predetermined time after the production of its output, and a monostable multivibrator connected between the counter circuit and the switching circuit such that the monostable multivibrator is triggered by the counter output and it is then returned to the initial state with a time constant which is equal to or smaller than the charging time constant of the internal power supply circuit whereby the switching circuit is triggered by the output pulse of the monostable multivibrator. The monostable multivibrator is designed so that when the power source is connected or the supply voltage is again applied upon releasing the detector, up to the time that the output voltage of the internal power supply circuit attains its stable level, even if the counter circuit produces an output, no trigger signal is applied to the switching circuit and the switching circuit is prevented from coming into operation. Thus there is an advantage that the production of a false alarm signal upon closing the power supply circuit as well as upon releasing is prevented, thus ensuring stable operation of the actually installed detectors and preventing deterioration in the efficiency of testing and adjusting works made before the shipment of detectors from the factory.

In accordance with another preferred embodiment of the invention, the detector further comprises a sensitivity validation circuit means for directing the input to the counter circuit or the output pulses of the comparator circuit to the outside so as to increase the efficiency of the testing and adjusting works. The provision of this circuit means allows to separately perform the performance testing of the storage function section including the counter circuit capable of being reset positively and the switching circuit adapted to be operated by the output of the counter circuit through the monostable multivibrator and the sensitivity adjustment and performance testing of the non-storage function section including the detecting circuit and the comparator circuit. More specifically, the circuit means comprises a light-emitting diode (LED) which is operated through the connection terminal or the comparator output terminal extended to the outside or the output of the comparator circuit and it is designed so that the output level of the non-storage function section can be measured by applying the output of the comparator circuit to a test measuring instrument through the circuit means and thus validation of the detection sensitivity and fine adjustment can be accomplished efficiently without requiring any storage interval. With the performance of the non-storage function section of the detector being guaranteed in this way, the storage performance test of the detector can be performed without the need to consider the detection sensitivity and thus there is no longer any need to place the detector in a simulated fire condition. In the case of a smoke detector, for example, this storage performance test can be accomplished by simply inserting, in place of the smoke, a suitable substitute such as a piece of paper or plastic sheet into the smoke detecting section to operate the detecting circuit and checking the time in seconds required for the switching circuit to operate after the operation of the detecting circuit, and thus the efficiency of the test works can be improved very remarkably.

The above and other objects, construction and effects of this invention will become more apparent from the following detailed description taken in conjunction with the accompanying drawings.

DESCRIPTION OF THE PREFERRED EMBODIMENTS

Figure 1:
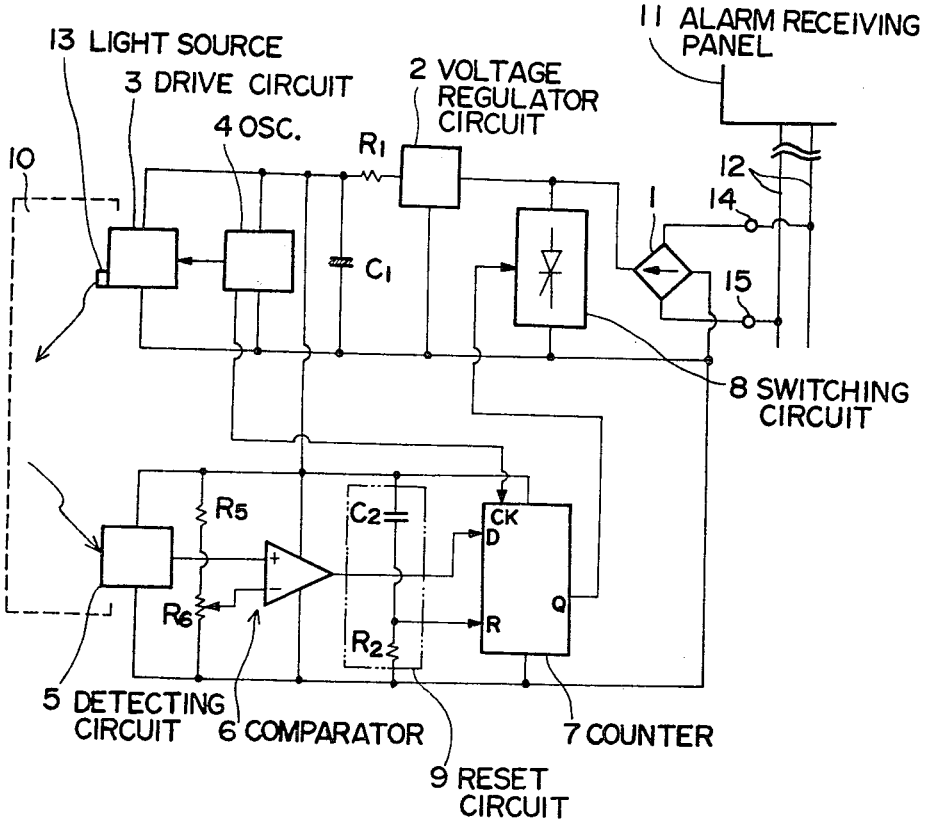
FIG. 1 PRIOR ART
FIG. 1 is a block circuit diagram showing the construction of a known storage type fire detector having a resetting differentiation circuit, which is by way of example in the form of a photoelectric smoke detector.

FIG. 1 shows the construction of a known type of storage type fire detector which is by way of example in the form of a photoelectric smoke detector which produces an alarm signal when it receives the scattered light of a source light produced by smoke. In the Figure, a pair of power supply and signal lines 12 connected to a DC source and a signal detecting relay (not shown) in an alarm receiving panel 11 are brought out therefrom, and the fire detector is connected between the lines 12 by means of its terminals 14 and 15. Numeral 1 designates a rectifier circuit comprising a diode bridge or the like which makes the connecting terminals 14 and 15 of the detector non-polarized with respect to the polarity of the DC source, and a switching circuit 8 comprising a thyristor or the like and a voltage regulator circuit 2 are connected between the output terminals of the rectifier circuit 1. The voltage regulator circuit 2 performs the dual functions of maintaining constant the DC supply voltage and limiting the current flow and a large-capacity capacitor $C_1$ is connected through a resistor $R_1$ to the constant-voltage output terminal of the voltage regulator circuit 2 so that the capacitor $C_1$ is charged with the limited current. Numeral 3 designates a drive circuit for a light source 13 included in a smoke detecting region 10, 4 an oscillator circuit for intermittently operating the drive circuit 3 at a predetermined period and for producing clock pulses which will be described later, 5 a detecting circuit whereby when the light from the light source 13 strikes against the smoke entering the smoke detecting region 10, the resulting scattered light is detected to produce a pulse output having an amplitude corresponding to the detected light quantity, and 6 a comparator circuit whereby the output pulse amplitude of the detecting circuit 5 is compared with a reference level adjusted and established by resistors $R_5$ and $R_6$ so as to produce a pulse when the output pulse amplitude is higher than the reference level. These elements form a so-called smoke sensor. Numeral 7 designates a counter circuit for counting the output pulses of the comparator circuit 6 in synchronism with the clock pulses so that when a predetermined number of the output pulses are counted continuously, an output is produced to operate the switching circuit 8. When the switching circuit 8 is operated by the output of the counter circuit 7, a short-circuit is established between the output terminals of the rectifier circuit 1 so that a low impedance is established between the lines 12 and the current detecting relay in the receiving panel 11 is operated. Thus the short-circuit signal serves as an alarm signal.

In the like manner as the ordinary non-storage type detectors, a plurality of such storage type detectors are connected between the lines 12 to form the alarm net of a fire alarm system.

As mentioned previously, although the drive current for the light source 13 lasts only for a short period of 100 to 200 μsec, the consumption of current amounts to several hundreds mA, and this current increases with an increase in the number of detectors connected to the same lines with the result that the effect of the pulse operation of the light source 13 appears between the lines 12 thus giving rise to the danger of operating the current detecting relay in the receiving panel 11. For this reason, as shown in FIG. 1, the capacitor $C_1$ having a relatively large capacitance is incorporated as an internal power supply so that when the power supply circuit is closed, the capacitor $C_1$ is charged through the resistor $R_1$ with the current limited by the voltage regulator circuit 2 and the required pulse current for operating the light source 13 is provided by means of the stored change in the capacitor $C_1$. The storage type detector includes the counter circuit 7 for the purpose of storage operation as mentioned previously, and in response to the closing of the power circuit in the receiving panel 11 the supply voltage to the counter circuit 7 increases with about a time constant determined by the capacitor $C_1$ and the resistor $R_1$. Since the counter circuit 7 is usually comprised of a plurality of stages, the output states of the respective stages are not fixed so that in certain circumstances there is the danger of the counter circuit 7 producing an output upon closing the power supply circuit and thereby operating the switching circuit 8 to produce a false alarm signal. For this reason, the known storage type detector includes a differentation circuit 9 comprising a capacitor $C_2$ and a resistor $R_2$ and thus the counter circuit 7 is forcibly reset by the differentiated output of the supply voltage increased upon closing the power supply circuit. In order to reset the counter circuit 7 through the differentiation circuit 9, generally a reset voltage of about one half the supply voltage produced by the voltage regulator circuit 2 is sufficient for the purpose.

Figure 2:
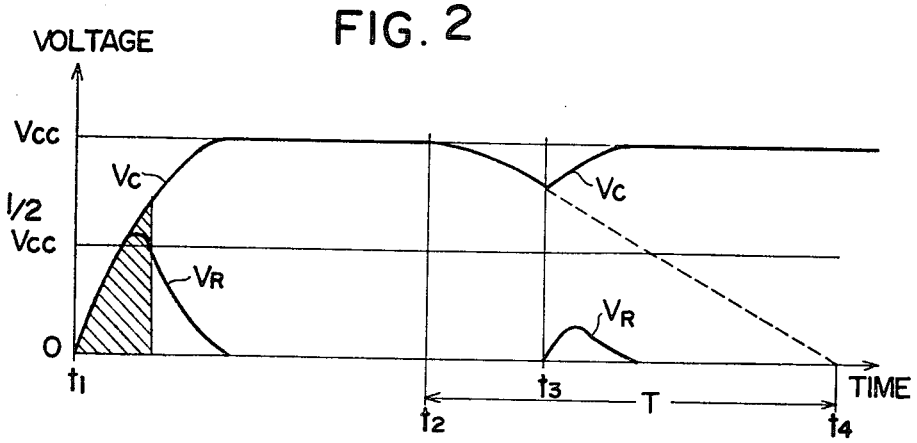
FIG. 2 is a graph showing the relationship between the variation in the circuit voltage upon closing the supply circuit and the variation in the reset voltage, with the abscissa representing the time and the ordinate representing the voltage value.

FIG. 2 shows the variation in the supply voltage Vc for the counter circuit 7 and the reset voltage Vr from the differentiation circuit 9 after the closing of the power supply circuit in the receiving panel 11. Assuming that the circuit for the supply voltage is closed at a time $t_1$, the supply voltage $V_c$ is stored in the capacitor $C_1$ with the time constant determined by the resistor $R_1$ and the capacitor $C_1$ toward the preset voltage Vcc of the voltage regulator circuit 2 so that the voltage change during the charging is taken out as a reset voltage $V_R$ by the differentiation circuit 9 and the counter circuit 7 is forcibly reset during the hatched transition period.

However, the resetting by the differentiation circuit 9 presents the following problem. Assume now that the detector is caused to make an alarm at a time $t_2$ which is later than the closing of the supply circuit. When the alarm is produced, the switching circuit 8 establishes a low impedance short-circuit between the pair of lines 12 from the receiving panel 11 to send an alarm signal to it and consequently the current is no longer supplied to the capacitor $C_1$. When this occurs, the stored charge in the capacitor $C_1$ is discharged to its loads including the oscillator circuit 4, the drive circuit 3, the detecting circuit 5, the comparator circuit 6 and the counter circuit 7 and thus the terminal voltage of the capacitor $C_1$ decreases gradually with a time constant determined by the constants of these load circuits. However, while, so long as the oscillator circuit 4 is oscillating, the current consumption of the drive circuit 3 is relatively high and the terminal voltage of the capacitor $C_1$ decreases at a relatively high rate, if Vcc=12 V, for example, the oscillator circuit 4 stops oscillating when the terminal voltage of the capacitor $C_1$ decreases to about 7.5 V. Thus, the oscillator circuit 4 stops oscillating in a very short period after the operation of the switching circuit 8. After the oscillation has been stopped, the drive circuit 3 no longer consumes any current and the current consumption of the other circuits is relatively small. Particularly, if the counter circuit 7 comprises a complementary metal oxide semiconductor (C-MOS) device, it will practically consume no current. As a result, after the oscillation of the oscillator circuit 4 has been stopped, the capacitor $C_1$ discharges at a very slow rate and the time required for completing the discharge, that is, the time interval T from $t_2$ to $t_4$ in FIG. 2 is in fact more than 10 minutes.

Usually, when an alarm signal is received by the receiving panel 11 so that an alarm produced by sounding, visual indication or the like caused by the operation of its current detecting relay is confirmed, the flow of the DC current to the line 12 is interrupted by the receiving panel 11 and the releasing operation of turning off the switching circuit 8 in the operated detector and closing again the power supply circuit is performed so as to confirm the presence of a fire. Generally, this releasing operation is performed in less than few minutes after the confirmation of the alarm and it is in no way performed after the expiration of over 10 minutes. In other words, after the alarm signal has been produced at $t_2$ on FIG. 2, the supply voltage to the counter circuit 7 drops at very slow rate and thus the reclosing of the power supply circuit by the releasing operation takes place before the capacitor $C_1$ completes its discharge and it occurs at a time $t_3$ in FIG. 2. When the power supply circuit is reclosed by the releasing operation at the time $t_3$, the supply voltage Vc to the counter circuit 7 again rises and the resulting voltage variation is so small that the resulting reset voltage $V_R$ cannot reach a voltage value sufficient to forcibly reset the counter circuit 7. Thus, since the counter circuit 7 remains an output at the time $t_3$, there still exists the danger of giving a false alarm upon reclosing the power supply circuit after the releasing.

In accordance with the present invention, such false alarm is prevented by positively resetting the counter circuit when the power supply circuit is closed and also when the power supply circuit is closed again due to the releasing operation and by preventing the switching circuit from being triggered during the periods of such supply voltage variation.

Figure 3:
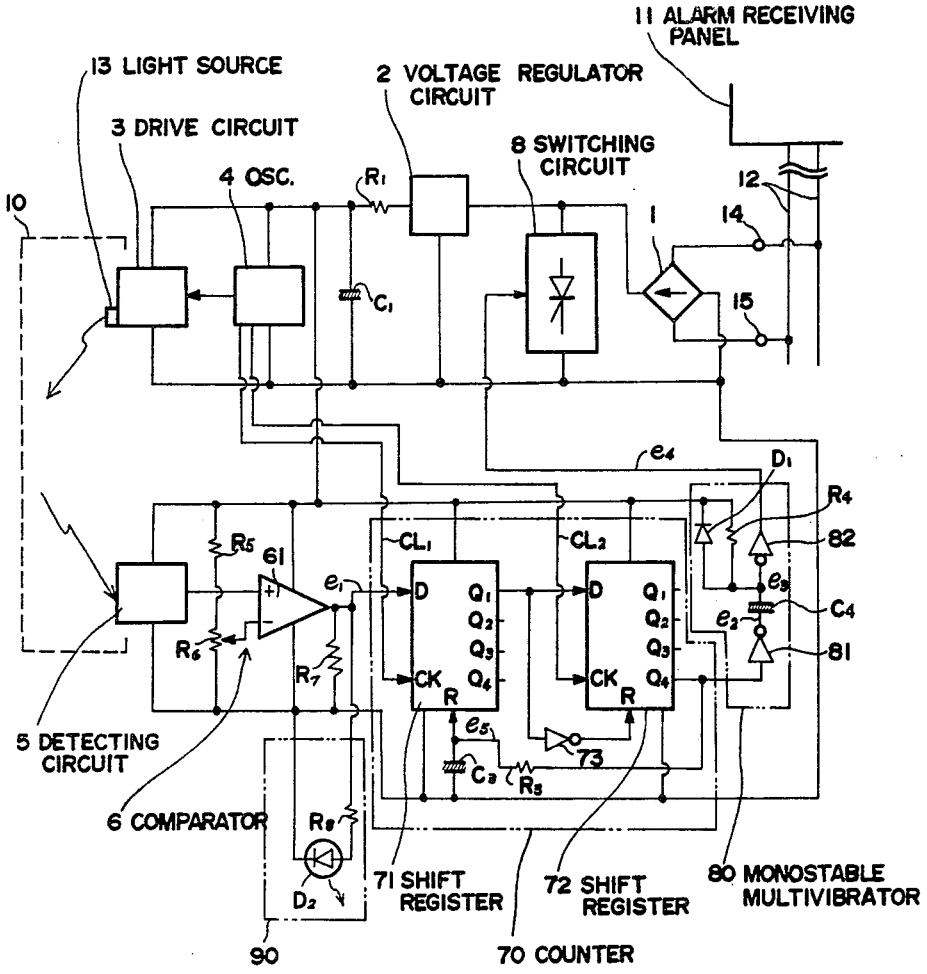
FIG. 3 is a circuit diagram showing part in block diagram form the construction of a storage type fire detector of this invention, which is by way of example in the form of a photoelectric smoke detector.

More specifically, FIG. 3 illustrates an embodiment of the invention in which those component parts identical or equivalent to the counterparts of FIG. 1 are designated by the same reference numerals. In the Figure, numeral 70 designates a counter circuit which corresponds to the counter circuit 7 of FIG. 1. Numeral 80 designates a monostable multivibrator, and 90 a sensitivity validation circuit means. The remaining component parts are the same in construction and operation with their counterparts of FIG. 1.

The counter circuit 70 comprises 4-stage static type shift registers 71 and 72 which are connected in cascade. The output signal $e_1$ of the comparator circuit 6 is applied to the data terminal D of the first-stage shift register 71 and its output terminal $Q_1$ which produces a fit flag in response to the first count is connected to the data terminal D of the second-stage shift register 72 whose fourth count output terminal $Q_4$ is connected to the monostable multivibrator 80. The clock terminals CK of the shift registers 71 and 72 respectively receive the clock pulses $CL_1$ produced by the oscillator circuit 4 at the same period but slightly delayed with respect to the drive pulses applied to the drive circuit 3 and the clock pulses $CL_2$ produced similarly at the same period but delayed a predetermined time with respect to the pulses $CL_1$, and the data are read into the shift register 71 and 72 in response to the leading edge of these clock pulses or shift pulses. The shift register 72 is reset by the output of an inverter 73 which inverts the output from the output terminal $Q_1$ of the shift register 71, and the shift register 71 is reset by a reset signal $e_5$ produced by integrating the $Q_4$ output of the shift register 72 through a resistor $R_3$ and a capacitor $C_3$.

The monostable multivibrator 80 comprises inverters 81 and 82 connected in cascade through a capacitor $C_4$, and the supply voltage is applied between the capacitor $C_4$ and the inverter 82 through a resistor $R_4$. The time required for the monostable multivibrator 80 to return to the initial state after it has been triggered by the $Q_4$ output of the shift register 72 is dependent on the charging time constant determined by the resistor $R_4$ and the capacitor $C_4$ and this time constant is preset to a value which is equal to or lower than the charging time constant of the supply voltage upon closing the power supply circuit or the time constant determined by the resistor $R_1$ and the capacitor $C_1$ as explained in connection with the prior art detector of FIG. 1. A diode $D_1$ is connected in parallel with the resistor $R_4$ so that when the inverter 81 inverts its input, the input voltage to the inverter 82 is prevented from increasing.

Figure 4:
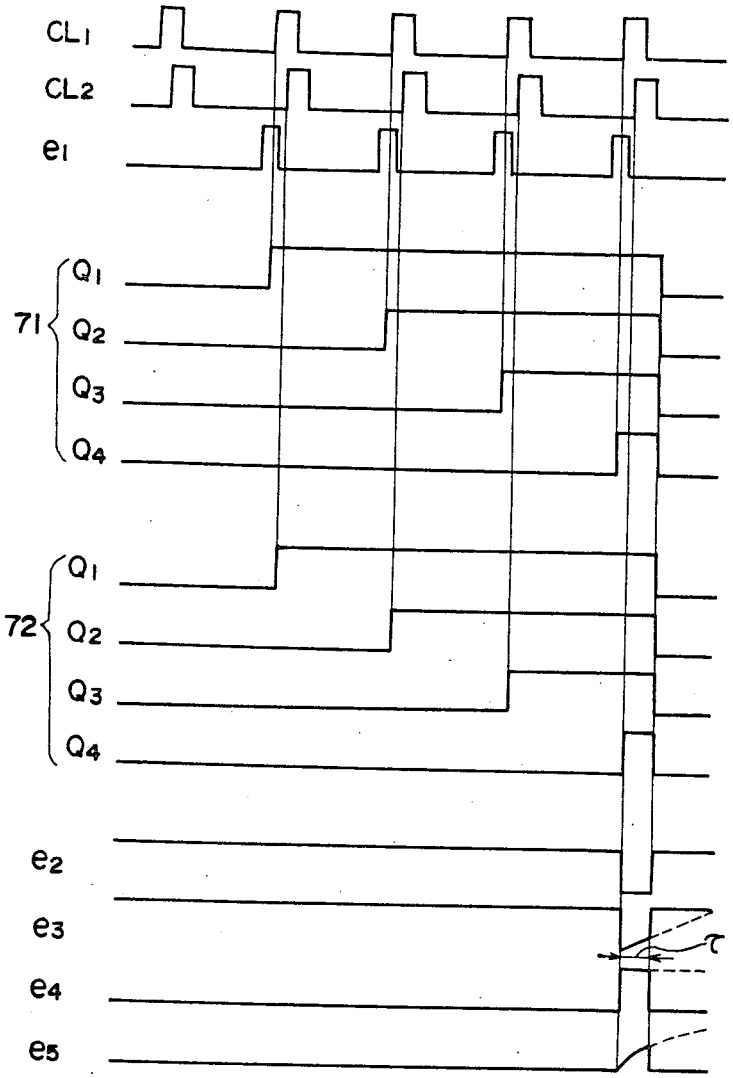
FIG. 4 is a time chart illustrating the waveforms generated at various points in the detector of FIG. 3 which are useful for explaining the operation thereof.

FIG. 4 illustrates the signal waveforms produced at various points in the embodiment of FIG. 3 when the four consecutive comparison output pulses $e_1$ are produced from the comparator circuit 6 with the power supply voltage being normal. The clock pulse $CL_2$ goes to the high level with a slight delay with respect to the pulses $CL_1$, and when the first comparison output pulse $e_1$ is read into the shift register 71 in response to the leading edge of the clock pulse $CL_1$, the output terminal $Q_1$ of the shift register 71 changes to the high level and the reading of the pulse $e_1$ into the shift register 72 is effected in response to the leading edge of the following clock pulse $CL_2$. Thereafter, each time a further comparison output pulse $e_1$ is produced, the data reading is effected by the corresponding clock pulses $CL_1$ and $CL_2$ and the bit shifting operation is effected in the shift registers 71 and 72, respectively. When the fourth comparison output pulse $e_1$ is read into the shift registers 71 and 72, all their output terminals go to the high level and a trigger pulse is applied to the monostable multivibrator 80.

The monostable multivibrator 80 is designed so that when the $Q_4$ terminal output of the shift register 71 goes to the low level, the output $e_2$ of the inverter 81 is changed to the high level so that the input $e_3$ to the inverter 82 is always held at the high level and the output $e_4$ applied from the inverter 82 to the switching circuit 8 is held at the low level. When the $Q_4$ output terminal of the shift register 72 changes to the high level, the output $e_2$ of the inverter 81 changes to the low level so that the input $e_3$ to the inverter 82 is also changed to the low level through the capacitor $C_4$. As a result, the output $e_4$ of the inverter 82 changes to the high level and a trigger signal is supplied to the switching circuit 8. When the output $e_2$ of the inverter 81 goes to the low level as mentioned, the capacitor $C_4$ is charged through the resistor $R_4$, so that after the expiration of a predetermined time, the input $e_3$ to the inverter 82 is raised to the high level and consequently the output $e_4$ of the inverter 82 is changed back to the low level. In other words, the charging time of the capacitor $C_4$ determines the pulse width $\tau$ of the trigger signal applied to the switching circuit 8.

On the other hand, the shift registers 71 and 72 are reset in the following manner. When the comparison output pulse $e_1$ is read into the shift register 71 so that its $Q_1$ terminal output changes to the high level, the reset state of the shift register 72 is released through the inverter 73, and the reset state of the shift register 71 is released so far as the $Q_4$ output terminal of the shift register 72 remains at the low level. When the $Q_4$ output terminal of the shift register 72 goes to the high level, after the expiration of a charging time determined by the resistor $R_3$ and the capacitor $C_3$ the reset signal $e_5$ reaches a predetermined reset voltage and the shift register 71 is reset. When this occurs, the second-stage shift register 72 is also reset and returned to the initial state through the inverter 73. In other words, the counter 70 is reset without continuously producing its output in excess of a predetermined time.

Next, the operation of the monostable multivibrator 80 upon closing the power supply circuit as well as upon reclosing the power supply circuit will be described with reference to the embodiment of FIG. 3.

Assume that in the normal operating condition, the DC output voltage of the voltage regulator circuit 2 is 12 volts, the operating point of the shift registers 71 and 72 comprising C-MOS devices is 3 volts, and the operating point of the oscillator circuit 4 for generating the clock pulses $CL_1$ and $CL_2$ and for controlling the drive circuit 3 is 7.5 volts.

When the power supply circuit is closed in the receiving panel 11, the voltage Vc across the terminals of the capacitor $C_1$ to which is applied the output voltage of the voltage regulator circuit 2, rises with a predetermined time constant as shown by the graph of FIG. 2 and it eventually rises to 3 volts, thus bringing the shift registers 71 and 72 and the monostable multivibrator 80 into operation. In this case, the oscillator circuit 4 has not reached the operating point so that the comparison output pulse $e_1$ will go to the low level and no clock pulses $CL_1$ and $CL_2$ will be produced. Thus, no data will be read into the shift registers 71 and 72 thus causing their output terminals $Q_1$ to $Q_4$ to go to the low level. However, since the shift registers 71 and 72 comprise flip-flops whose low or high level at the output terminals upon reaching the operating point cannot be determined definitely, there is the possibility that the $Q_4$ output terminal of the shift register 72 goes to the high level when the operating point is reached. Assuming that the $Q_4$ output terminal of the shift register 72 goes to the high level upon reaching the operating point of $V_c=3$ volts, the output $e_2$ of the inverter 81 in the monostable multivibrator 80 goes to the low level. However, since the time constant of the resistor $R_4$ and the capacitor $C_4$ has a value which is equal to or lower than the charging time constant determined by the capacitor $C_1$ and the resistor $R_1$, the input $e_3$ to the inverter 82 substantially follows and becomes equal to the supply voltage $V_c$ so that the input $e_3$ to the inverter 82 is not changed to the low level but held at the high. As a result, the output of the inverter 82 is always maintained at the low level during the transition periods after the closing of the power supply circuit and no trigger signal is applied to the switching circuit 8, thus eliminating the danger of producing any false alarm. Of course, if the $Q_4$ output terminal of the shift register 72 is at the low level when the operating point is reached, the output $e_2$ of the inverter 81 is at the high level so that the power supply voltage $V_c$ becomes the input $e_3$ to the inverter 82 and thus the output $e_4$ of the inverter 82 is always held at the low level.

When the power supply voltage $V_c$ increases further so that it reaches 7.5 volts or the operating point of the oscillator circuit 4, the clock pulses $CL_1$ and $CL_2$ are applied to the shift registers 71 and 72 so that if no smoke is present in the smoke detecting region 10, the output $e_1$ of the comparator circuit 6 always remains at the low level so that the inverter 73 resets the shift register 72 and its output terminal $Q_4$ goes to the low level. This eliminates the danger of any malfunctioning of the detector and the detector comes into a normal operation.

On the other hand, when the detector gives an alarm so that the power supply voltage $V_c$ gradually decreases and then the power supply circuit is closed again as the result of the releasing operation, even if the supply voltage $V_c$ has dropped below the operating point of the shift registers 71 and 72 or that of the oscillator circuit 4, during the transition period due to the reclosing, in the same manner as mentiond previously the output of the monostable multivibrator 80 is held at the low level and no trigger signal is produced unless four output pulses $e_1$ from the comparator circuit 6 are again counted, thus positively preventing the production of any false alarm upon closing or reclosing the power supply circuit.

It will thus be seen from the foregoing that in accordance with the storage type fire detector of this invention, by virtue of the fact that a monostable multivibrator having a time constant which is equal to or smaller than the power supply time constant of the detector is provided between a counter circuit for initiating the storage operation by counting the outputs of a comparator circuit which periodically selects the signals higher than a reference level and a switching circuit for sending a fire alarm signal to a receiving panel, there are the advantages of completely eliminating the occurrence of any false alarm during the transition periods following the closing of the power supply circuit as well as the reclosing of the power supply circuit upon releasing operation and further improving the reliability of the storage type fire detector.

These advantages afford new and more efficient work procedures for the individual performance testing and adjustment works of storage type fire detectors before their shipment from the factory in addition to those of the detectors used in the actual fire alarm system.

In other words, generally the performance test of the storage type fire detector is accomplished by placing the unit in a mass of smoke of a predetermined density and checking the production of an alarm and the time required for the production of the alarm, and in this case it is important to confirm the stability of the detector performance by performing the releasing operation several times along with the performance testing.

In the case of the detector according to the invention, the occurrence of any malfunction upon closing the power supply circuit as well as upon releasing can be effectively prevented and the above-mentioned stability confirmation can be effected satisfactorily by a single releasing operation with the resulting great decrease in the required time.

Further, the provision of the circuit means 90 for directly taking the outputs of the comparator circuit 6 to the outside as shown in FIG. 3 has the effect of further improving the work efficiency. More specifically, the comparator circuit 6 includes an operational amplifier 61 in which one input terminal (+) receives the differentiated output voltage $V_d$ from the detecting circuit 5 and the other input terminal (−) receives the reference voltage $V_{ref}$ produced through division by resistors $R_5$ and $R_6$ and adjustment by the variable resistor $R_6$. The magnitude of the reference voltage $V_{ref}$ determines the sensitivity of the detector.

According to an embodiment of the sensitivity validation circuit 90 connected to the output terminal of the operational amplifier 61 of the comparator circuit 6, it comprises a series circuit of a resistor $R_8$ and a light-emitting diode or LED $D_2$ which is connected in parallel with an output resistor $R_7$ of the amplifier 61 whereby when the differentiated output $V_d$ of the detecting circuit 5 becomes $V_d > V_{ref}$, the output of the operational amplifier 61 is inverted and this inverting operation supplies a pulse drive current to the LED $D_2$ of the sensitivity validation circuit 90, causing the LED $D_2$ to produce a pulse light to the outside in synchronism with the output pulse of the comparator circuit 6. This pulse light in fact lasts only momentarily so that the light is not perceivable by the human eyes.

Figure 5:
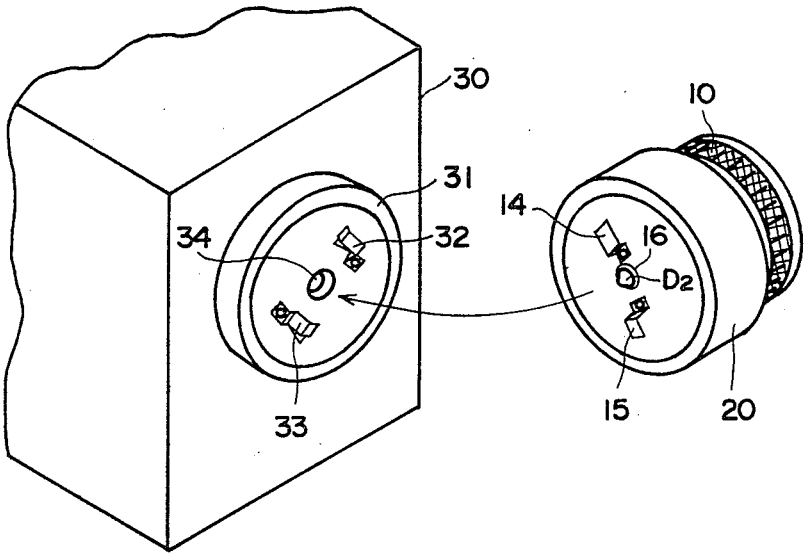
FIG. 5 is a perspective view of a detector mounting base for adjustment testing purposes.

As shown in FIG. 5, the LED $D_2$ is mounted on the inner printed-wiring board such that the LED $D_2$ sticks out from a hole 16 formed substantially in the center of the back side of a detector proper casing 20 and the pulse light from the LED $D_2$ is projected to the outside through the hole 16. Numerals 14 and 15 designate twist-locking type mounting terminal strips which are fitted in the fixtures of a mounting base fixed to the ceiling, for example, so as to provide the fixing and connections to the lines. As shown in FIG. 5, a detector sensitivity testing device 30 is provided on its outer surface with a detector mounting base 31, and the mounting base 31 is formed substantially in the center thereof with a hole 34 extending to the inside of the device 30 so that the hole 34 aligns with the hole 16 in the back of the detector when the detector 20 is mounted by fitting the terminal strips 14 and 15 to fixtures 32 and 33, and disposed inside the device 30 is a light-sensitive element for receiving the pulse light from the LED $D_2$ through the hole 34. The light-sensitive element may for example a photo diode or photo transistor.

Figure 6:
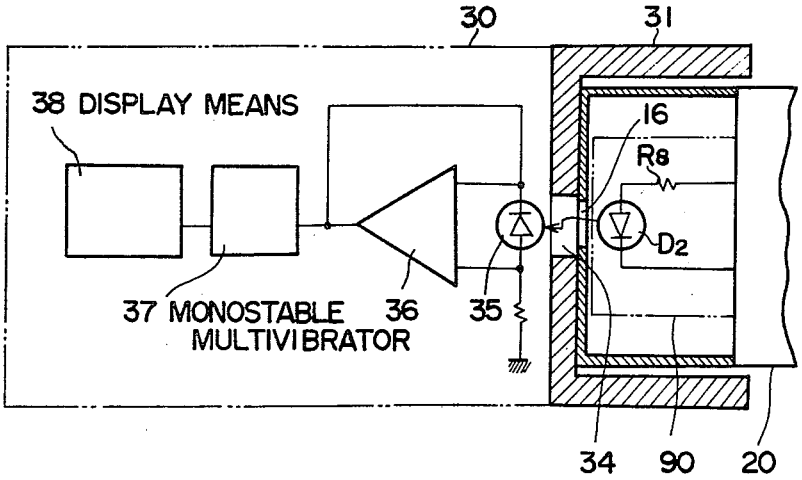
FIG. 6 is a block circuit diagram showing by way of example a sensitivity test device.

FIG. 6 shows the circuit construction of the testing device 30 for receiving the pulse light from the LED $D_2$, and it includes a light-sensitive element 35 disposed to face the LED $D_2$ so that the photoelectric conversion output of the light-sensitive element 35 triggers a monostable multivibrator 37 through an amplifier 36, and a display means 38 is operated by the output of the monostable multivibrator 37 to thereby confirm the sensitivity by means of a bruzzer, lamp or the like.

If this testing device 30 is used to test the detector by supplying to it smoke of a predetermined density, the sensitivity setting adjustment of the detector can be accomplished by means of the sensitivity validation circuit means 90 without resort to the storage operation time of over 20 seconds, for example, and the sensitivity testing device 30 displays the alarming operation of the detecting circuit 5 in response to the operation of the LED $D_2$ caused by the inverting operation of the comparator circuit 6 effected at pulse operation intervals of 8 seconds, for example, which is determined by the oscillation frequency of the oscillator circuit 4. In this way, the adjustment of the variable resistor $R_6$ with respect to the desired set sensitivity can be made in a short period of time while confirming the performance of the detector.

According to another embodiment of the sensitivity validation circuit 90 shown in FIG. 6, the LED $D_2$ is replaced with a connecting terminal means of the twist-locking terminal structure which connects the output terminal of the comparator circuit 6 directly to the input of the testing device 30.

Since the above-described sensitivity adjustment by the testing device 30 is performed irrespective of the storage operation, the sensitivity adjustment can be accomplished very efficiently and it is only necessary for the detector passed the test to be subjected to a storage operation validation test. The storage operation validation test can be performed by simply checking the time in seconds required for the switching circuit 8 to come into operation after the operation of the detecting circuit 5 and there is no need to place the detector in any smoke. As a result, the storage operation test can be accomplished by simply inserting a suitable material such as a piece of paper or plastic sheet or a rod into the smoke detecting means of the detector so as to forcibly bring the detecting circuit 5 into operation. Thus, as compared with the testing method using smoke of a predetermined density, the testing work can be accomplished easily in a short period of time. Thus, coupled with the elimination of an malfunction upon releasing operation, the resulting overall improvement in the testing efficiency is immeasurable.

What is claimed is:

1. In a count discriminating fire detector comprising a detecting circuit responsive to a change in a physical parameter indicative of a fire such as smoke, heat, flame or the like and adapted to be operated by pulses so as to produce at a predetermined period a pulse output having an amplitude corresponding to the degree of said change, a comparator circuit for producing a detection pulse in synchronism with said period when the amplitude level of said pulse output exceeds a predetermined reference level, a counter circuit for producing an output when a predetermined number of said detection pulses are applied thereto consecutively, said counter circuit being adapted to be reset at the expiration of a predetermined time after the application of said detection pulses is interrupted, a switching circuit responsive to said output of said counter circuit to produce an alarm signal, an oscillator circuit adapted for pulse operating said detecting circuit, a first capacitor for supplying by its stored charge a supply power to said detecting circuit, said comparator circuit, said counting circuit and said oscillator circuit, and a voltage regulator circuit for supplying a constant-voltage DC output to said first capacitor, said voltage regulator circuit having a current limiting function, wherein said switching circuit is connected to a pair of power supply and signal lines from an alarm receiving panel for receiving a DC supply power through said lines and for establishing, when operated, a low impedance between said lines to send an alarm signal to said receiving panel, and wherein said detecting circuit, said comparator circuit, said counter circuit and said oscillator circuit are supplied with said DC supply power from said lines through said voltage regulator circuit and said first capacitor, the improvement comprising:

a monostable multivibrator connected between an output of said counter circuit and an input of said switching circuit, said monostable multivibrator having a time constant equal to or smaller than a time constant for charging said capacitor by the output of said voltage regulator circuit, whereby during a transition period just following the closing of a circuit for said DC supply power the output of said counter circuit applied to said monostable multivibrator is not supplied to the input of said switching circuit.

2. A fire detector according to claim 1, wherein said monostable multivibrator comprises a first inverter for inverting the output of said counter circuit to produce an output, a second inverter cascade connected to an output of said first inverter through a second capacitor, circuit means for applying a terminal voltage of said first capacitor to a junction point between said second capacitor and an input of said second inverter through a resistor, and a diode connected in parallel with said resistor in reverse polarity relation, said second inverter having an output connected to the trigger input of said switching circuit.

3. A fire detector according to claim 1, further comprising an integrator circuit for resetting said counter circuit when the output of said counter circuit continues in excess of a predetermined time.

4. A fire detector according to claim 3, wherein said counter circuit comprises first and second shift registers each having the same number of shift stages, wherein the detection pulses from said comparator circuit are applied to a data input terminal of said first shift register, wherein a first count output terminal of said first shift register is connected to a data input terminal of said second shift register, wherein a final count output terminal of said second shift register is connected to the input terminal of said monostable multivibrator, wherein a reset state of said second shift register is released when an output is produced at said first count output terminal of said first shift register, wherein said first shift register is reset when an output is continuously produced at said final count output terminal of said second shift register in excess of a predetermined time, wherein the reading of input data into said first shift register is controlled by first clock pulses having the same period as said detecting circuit pulse operation but delayed with respect thereto, and wherein the reading of input data into said second shift register is controlled by second clock pulses having the same period as said first clock pulses but delayed with respect thereto.

5. A fire detector according to claim 1, further comprising sensitivity validation circuit means connected to the output terminal of said comparator circuit such that the detection pulses from said comparator circuit are taken to the outside through said sensitivity validation circuit means.

6. A fire detector according to claim 5, wherein said sensitivity validation circuit means includes a light-emitting diode responsive to the detection pulse from said comparator circuit to emit a pulse light to the outside.

* * * * *